US006790097B1

(12) United States Patent
Edwards et al.

(10) Patent No.: US 6,790,097 B1
(45) Date of Patent: Sep. 14, 2004

(54) SYSTEM AND METHOD FOR PREVENTING CABLE DISCHARGE EVENTS

(75) Inventors: James W. Edwards, Austin, TX (US); Craig A. Zimmerman, Austin, TX (US); Robert A. Marshall, Austin, TX (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 10/338,576

(22) Filed: Jan. 8, 2003

(51) Int. Cl.[7] ..... H01R 24/00; H01R 13/53
(52) U.S. Cl. ..... 439/676; 439/181; 439/607
(58) Field of Search ..... 439/676, 101, 439/108, 218, 181, 607, 610, 620

(56) References Cited

U.S. PATENT DOCUMENTS

| | | | | | |
|---|---|---|---|---|---|
| 4,223,368 | A | | 9/1980 | Dattilo | 361/220 |
| 4,477,134 | A | | 10/1984 | Wright | 339/17 |
| 4,677,520 | A | | 6/1987 | Price | 361/220 |
| 5,031,076 | A | | 7/1991 | Kiku | 361/424 |
| 5,059,140 | A | | 10/1991 | Philippson et al. | 439/607 |
| 5,087,210 | A | | 2/1992 | Myers et al. | 439/425 |
| 5,147,223 | A | | 9/1992 | Black et al. | 439/620 |
| 5,161,991 | A | | 11/1992 | Bauer | 439/181 |
| 5,164,880 | A | | 11/1992 | Cronin | 361/220 |
| 5,167,516 | A | | 12/1992 | Tan et al. | 439/141 |
| 5,224,878 | A | | 7/1993 | Lurie et al. | 439/620 |
| 5,256,074 | A | | 10/1993 | Tan et al. | 439/108 |
| 5,256,085 | A | | 10/1993 | Tan et al. | 439/607 |
| 5,268,592 | A | | 12/1993 | Bellamy et al. | 307/43 |
| 5,342,220 | A | | 8/1994 | Kodama | 439/607 |
| 5,357,402 | A | | 10/1994 | Anhalt | 361/753 |
| 5,405,000 | A | | 4/1995 | Hagedon et al. | 206/216 |
| 5,449,299 | A | * | 9/1995 | Shimirak et al. | 439/417 |
| 5,532,901 | A | | 7/1996 | Hawkins et al. | 361/212 |
| 5,537,294 | A | | 7/1996 | Siwinski | 361/753 |
| 5,563,450 | A | | 10/1996 | Bader et al. | 257/785 |
| 5,567,168 | A | | 10/1996 | Marsh et al. | 439/181 |
| 5,654,860 | A | | 8/1997 | Casper et al. | 361/91 |
| 5,797,767 | A | | 8/1998 | Schell | 439/490 |
| 5,947,773 | A | * | 9/1999 | Karam | 439/676 |
| 6,468,097 | B1 | | 10/2002 | Bernstein et al. | 439/181 |
| 6,162,856 | A1 | | 9/2003 | McCormack | 439/188 |

* cited by examiner

*Primary Examiner*—Michael C. Zarroli
(74) *Attorney, Agent, or Firm*—Baker Botts L.L.P.

(57) ABSTRACT

According to one embodiment of the invention, an apparatus includes a housing having a cavity configured to receive a plug. The apparatus includes a plurality of conductive pins each configured to contact a respective one of a plurality of conductive pins on the plug when the plug is inserted into the cavity. The apparatus also includes a discharge conductor system configured to contact at least one of the plurality of the conductive pins on the plug before complete insertion of the plug into the cavity and a discharge circuit coupling the discharge conductor system to ground.

38 Claims, 5 Drawing Sheets

SYSTEM AND METHOD FOR PREVENTING CABLE DISCHARGE EVENTS

FIELD OF THE INVENTION

This invention relates generally to data communications and more particularly to a system and method for preventing cable discharge events.

BACKGROUND OF THE INVENTION

Ethernet switches and other types of equipment can easily be damaged or destroyed by a cable discharge event (CDE). A cable discharge event may occur when a cable is installed where a static charge builds up on the cable. Dragging a cable across a floor or through a cable tray can generate the necessary friction to deposit charge on the cable. When the cable is plugged into the switch, or other device, the charge is transferred to the device, sometimes destroying portions of the device.

Techniques at addressing this problem have not been entirely successful. One approach is to design protection into the silicon of the switch, or other device, to withstand the electrostatic discharge. One example would be to add a diode on the pins to which the cable is connected. However, the size of the diode is limited, resulting in relatively small CDE protection.

SUMMARY OF THE INVENTION

According to one embodiment of the invention, an apparatus includes a housing having a cavity configured to receive a plug. The apparatus includes a plurality of conductive pins each configured to contact a respective one of a plurality of conductive pins on the plug when the plug is inserted into the cavity. The apparatus also includes a discharge conductor system configured to contact at least one of the plurality of the conductive pins on the plug before complete insertion of the plug into the cavity and a discharge circuit coupling the discharge conductor system to ground.

Some embodiments of the invention provide numerous technical advantages. Some embodiments may benefit from some, none, or all of these advantages. For example, according to one embodiment of the invention, a connector is provided that allows discharge of any electrical charge stored on a cable during insertion of an associated plug into a connector. This is desirable because device destruction may be avoided through undesired direct discharge of the electric charge to sensitive portions of the device. This results in greater device reliability, which is desirable. In addition, such a procedure may be performed without any additional steps required by the user of such a system and this approach may be implemented with little additional cost.

Other technical advantages may be readily ascertained by one of skill in the art.

BRIEF DESCRIPTION OF THE DRAWINGS

Reference is now made to the following description taken in conjunction with the accompanying drawings, wherein like reference numbers represent like parts, in which.

DETAILED DESCRIPTION OF THE INVENTION

Embodiments of the invention are best understood by referring to FIGS. 1 through 5 of the drawings, like numerals being used for like and corresponding parts of the various drawings.

Figure 1:
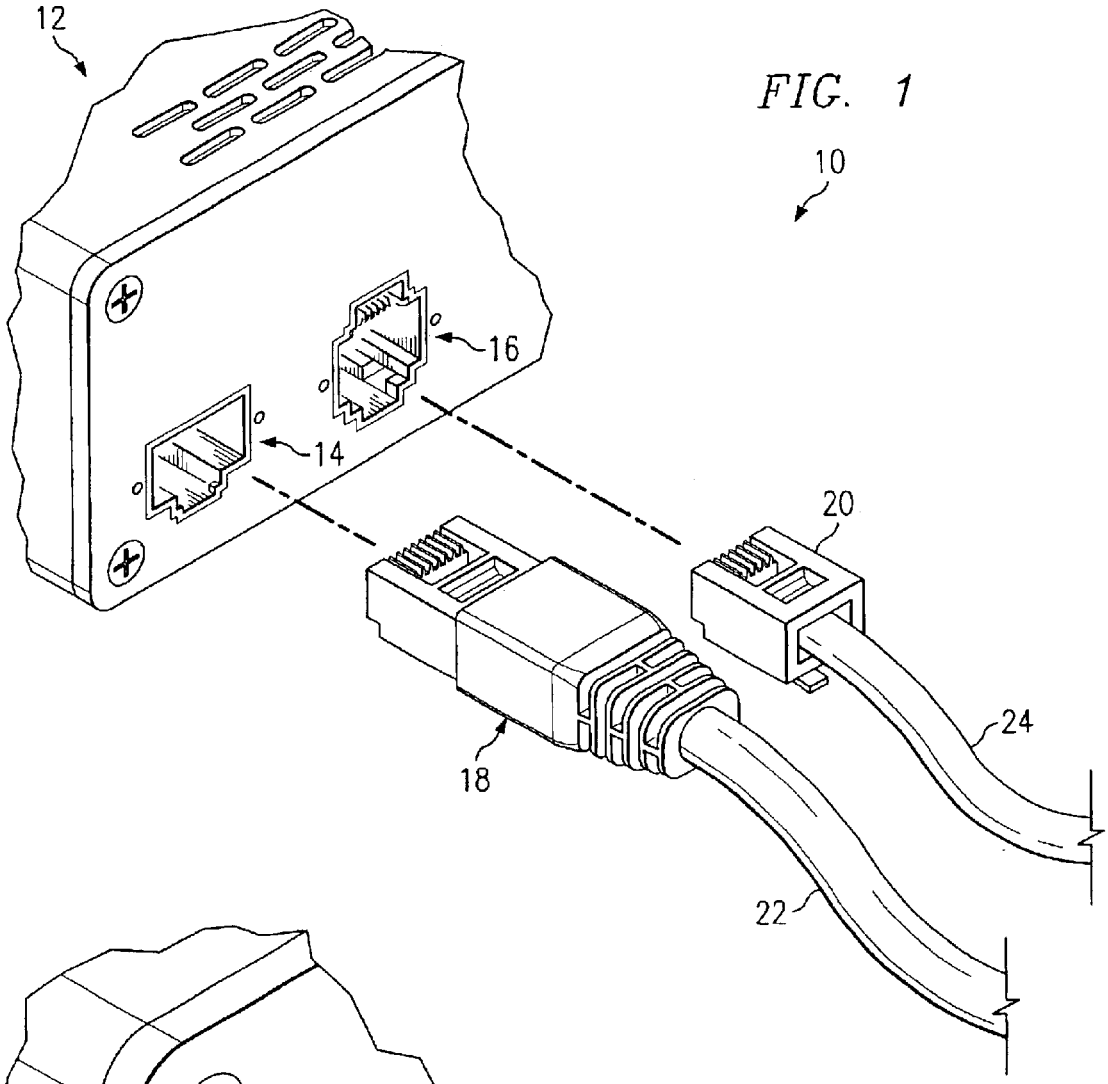
FIG. 1 is a perspective drawing of a system that may benefit from the teachings of the invention.

FIG. 1 is a perspective drawing of a system 10 that may benefit from the teachings of the present invention. System 10 includes a device 12, which in this example is an Ethernet switch, to which a cable is to be connected. Illustrated in FIG. 1 for description purposes are two types of RJ connectors: an RJ45 connector 14 and an RJ11 connector 16. Although an Ethernet switch 12 may conventionally utilize only one of these connectors, in particular an RJ45 connector 14, both are illustrated to emphasize the teachings of the invention are applicable to all types of RJ connectors, as well as other types of connectors. An "RJ" connector refers to a "Recommended Jack" connector and is well known in the industry.

RJ45 connector 14 receives an RJ45 plug 18. RJ45 plug 18 connects a cable 22 to some desired device (not explicitly shown). Similarly, RJ11 connector 16 receives an RJ11 plug 20, which is connected to a cable 24 for coupling Ethernet switch 12 to another device (not explicitly shown). RJ45 connector is often used to transmit data in Ethernet switches as well as other types of information; however such connections may have other uses. An RJ11 connector 16 is often utilized for telephone transmissions, but may be used for other types of communication.

As described above, a problem with connecting plugs 18 and 20 to Ethernet switch 12 is that an electrical charge may have built-up on the respective cables 22 and 24. When inserted into the respective connector 14 and connector 16 the built up charge discharges to the data pins within connector 14 and connector 16, which could result in destruction of the Ethernet switch 12 itself. The teachings of the invention recognize that it is desirable to somehow discharge this built up charge on cables 22 and 24 before damage occurs to portions of Ethernet switch 12. FIGS. 2A through 5 provide details associated with such an apparatus and method.

Figure 2A:
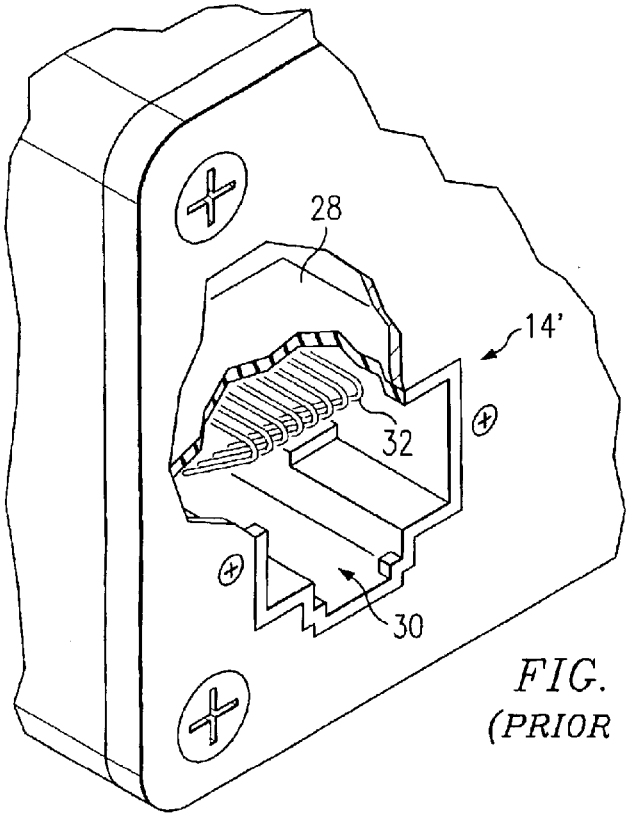
FIG. 2A (PRIOR ART)
FIG. 2A is a prior art figure showing a perspective view of a conventional RJ connector.
Figure 2B:
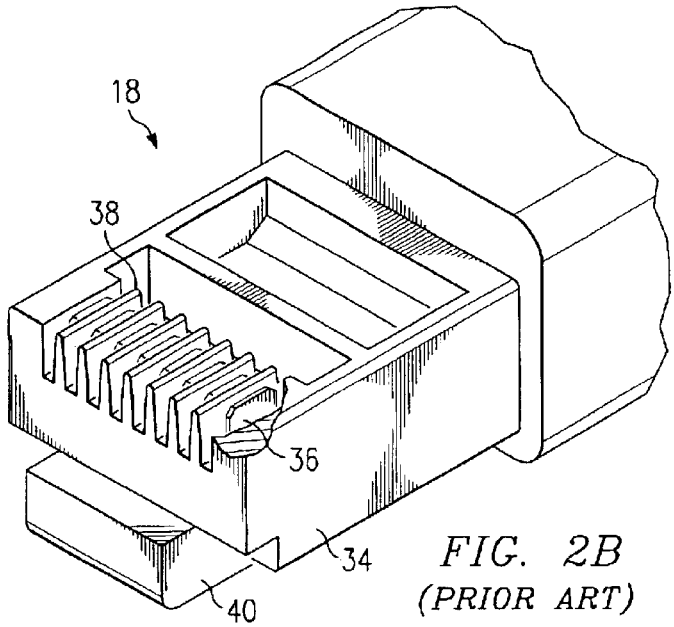
FIG. 2B (PRIOR ART)
FIG. 2B is a prior art figure showing a perspective view of a conventional RJ plug.

FIG. 2A is a prior art perspective drawing of a conventional RJ45 connector 14'. As described above the teachings of the invention are applicable to any type of RJ plug or other plug, but for illustration purposes an "RJ45" plug is utilized throughout the remainder of this description. RJ45 connector 14' includes a housing 28 with a cavity 30 formed therein. A plurality of connector conductive pins 32 are provided for connection to associated pins on plug 18 (FIG. 2B). Conductive pins 32 may carry electrical signals, including data or power to Ethernet switch 12. As described above, the teachings of the invention are also applicable to any device using such a plug and are not limited to Ethernet switches. FIG. 2B is a perspective drawing of a prior art RJ45 plug 18. As illustrated, plug 18 includes a housing 34 having formed within a plurality of plug conductive pins 36 electrically separated by a plurality of plug dividers 38. Conventionally, dividers 38 are formed from an insulative material, such as plastic, and connector conductive pins 36 are formed from a conductive metal; however, other materials may be used in such a plug for use with the present invention that result in appropriate transmission and isolation of electrical signals on conductive connector pins 36. RJ45 plug 18 also includes a latch 40 for securing plug 18 into connector 14 or 14', as illustrated in greater detail in FIGS. 4A through 4C.

Figure 3A:
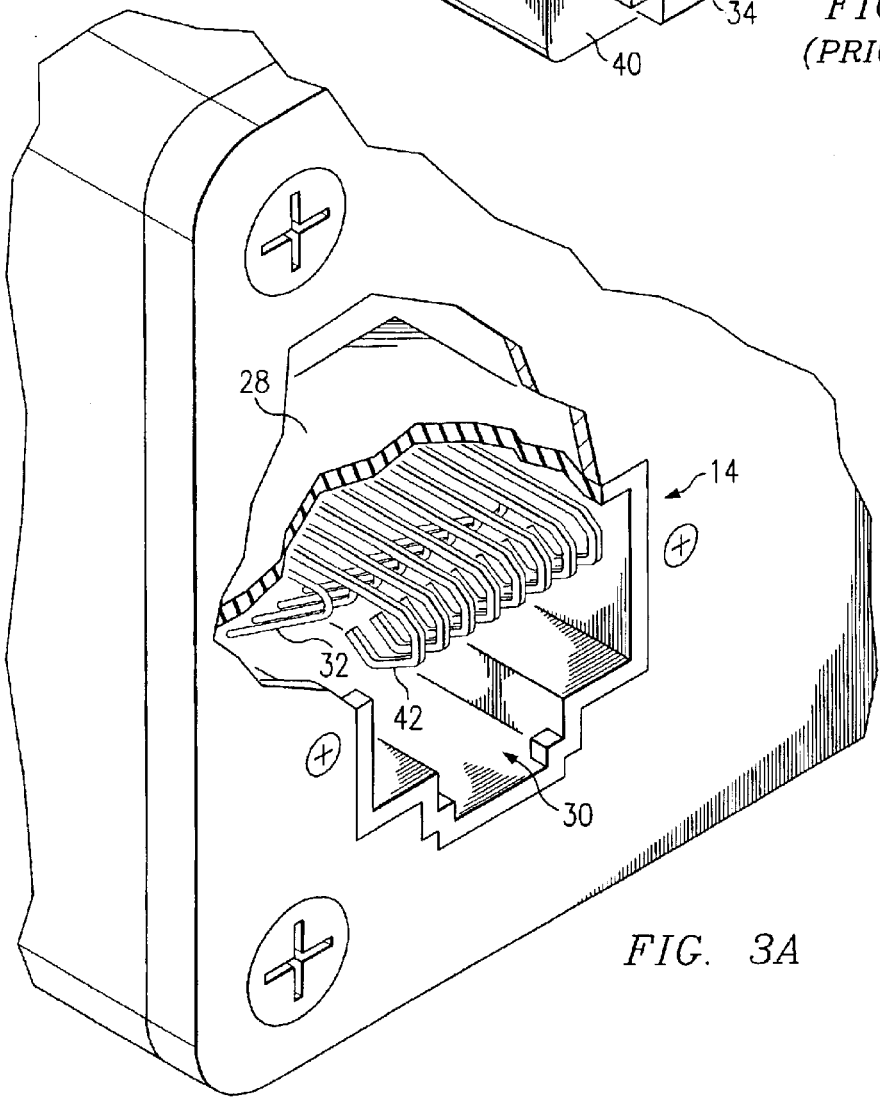
FIG. 3A is a perspective drawing showing a connector according to the teachings of the invention.

FIG. 3A is a perspective drawing of a connector 14 according to the teachings of the invention. Connector 14 includes a housing 28 having a cavity 30 formed therein for reception of a plug, such as plug 18. Connector 14 also includes a plurality of connector conductive pins 32 for connection to a plurality of plug conductive pins such as plug conductive pins 36. Any suitable number of pins may be used, including four, six, eight, or other number of pins. In addition, according to the teachings of the invention a plurality of discharge pins 42 are also formed in connector 14. In general, discharge pins 42 are designed such that, upon insertion of plug 18 into connector 14, discharge pins 42 electrically contact plug conductive pins 36, thereby allowing discharge of any charge stored on the plug conductive pins 36 and inhibiting discharge of that charge to connector conductive pins 32 of connector 14. Such a design allows automatic discharge of electricity stored on cables 22 and does not require an additional separate discharge procedure for protection of Ethernet switch 12. Thus, Ethernet switch 12 may be protected without additional requirements of the user of system 10 to go through a discharge procedure or requiring expensive equipment modifications. Details of examples of discharge pins 42 are described below.

Figure 3B:
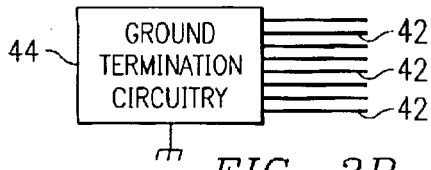
FIG. 3B is a block diagram illustrating connection of a portion of the connector of FIG. 3A to a ground termination circuit.

FIG. 3B is a block diagram illustrating connection of discharge pins 42 to a ground termination circuit 44. As illustrated, discharge pins 42 may be coupled to a ground termination circuit 44, which may allow discharge of any charge stored on cable 22 to ground. Ground termination 44 circuit may take any suitable form and may be located at any convenient location. For example, ground termination circuit 44 may be located within Ethernet switch 12, or on a printed circuit board coupled to Ethernet switch 12, or other suitable location. Ground termination circuit may be electrically coupled to a metal casing on connector housing 28 or may connect to an extra pin on Ethernet switch 12 (not explicitly shown). Examples of ground termination circuit 44 include a direct short to ground, a resistor connected to ground, a diode connected to ground, and other suitable ground termination circuits. Other ground termination circuits well known in the art may also be utilized, including termination circuits that do not affect the signal to be transmitted, such as RC termination circuits or a zener diode.

FIGS. 4A through 4D illustrate a series of cross-sectional diagrams illustrating the insertion of plug 18 into connector 14 and the resulting electrical connection and disconnection of discharge pins 42 with plug conductive pins 36, thereby allowing discharge of any charge stored on cable 22. In these views, only a single discharge pin 42 and a single plug conductive pin 36 may be seen.

Figure 4A:
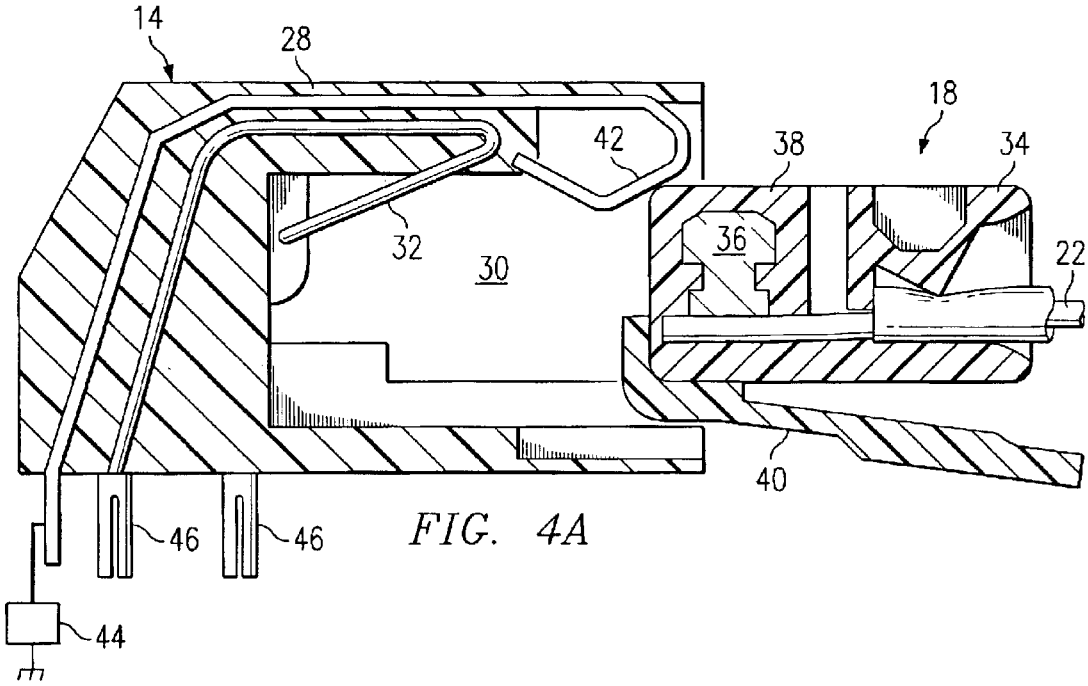
FIGS. 4A through 4D are a series of cross-sectional diagrams showing insertion of a plug into the connector of FIG. 3A according to the teachings of the invention.
Figure 4B:
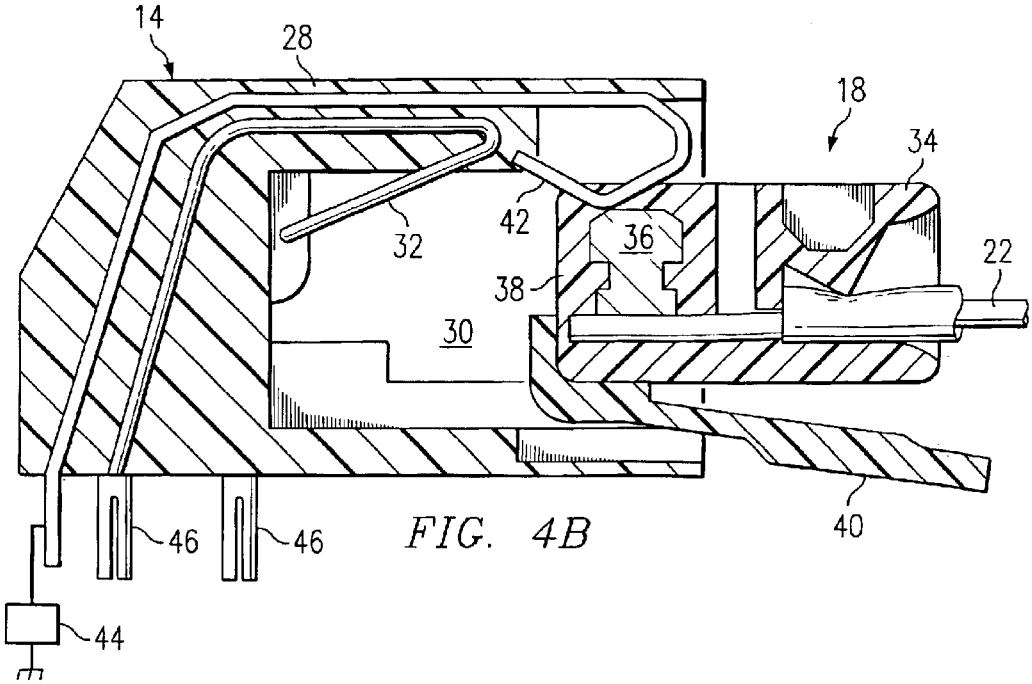

FIG. 4A shows an initial insertion of plug 18 into connector 14. In this position, discharge pins 42 begin to slide between dividers 38, but have not yet made contact with plug conductive pins 36. In FIG. 4B, plug 18 is inserted further into cavity 30 to the point that discharge pins 42 contact associated conductive plug pins 36. This contact allows any charge stored on cable 22 to flow through discharge pins 42 to ground termination circuit 44, which allows discharge of such electricity to ground. Also illustrated in FIGS. 4A through 4D are pins 46 associated with connector 14 for electrically coupling electrical signals received by connector 14 to Ethernet switch 12.

Figure 4C:
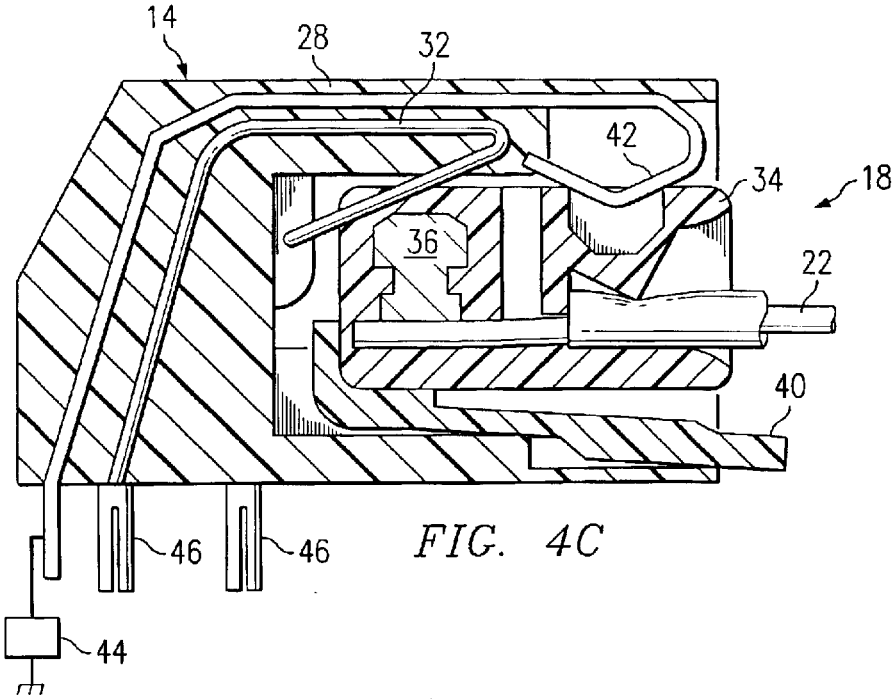
Figure 4D:
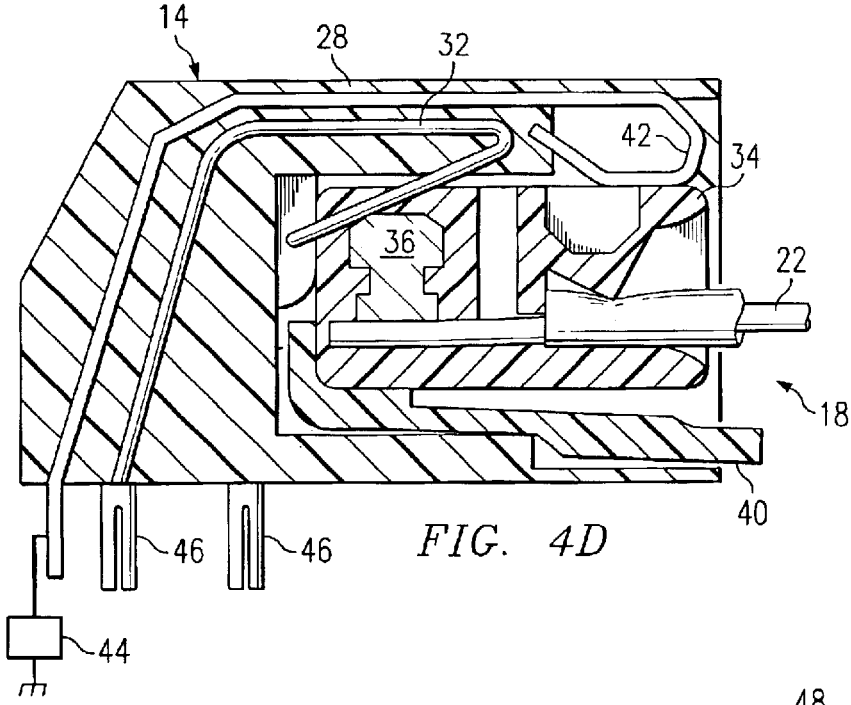

In FIG. 4C, plug 18 is inserted almost all the way into cavity 30 such that plug conductive pins 36 have been disconnected from discharge pins 42, but have not yet contacted connector conductive pins 32. In FIG. 4D, complete insertion of plug 18 into connector 14 results in contact between plug conductive pins 36 and connector conductive pins 32, allowing electrical signals to be transmitted through pins 46 to Ethernet switch 12. Because any stored electric charge on cable 22 was discharged during insertion, electrically coupling plug conductive pins 36 to connector conductive pins 32 at this point will not result in discharge of any stored electric charge to pins 46 or to Ethernet switch 12, which could otherwise destroy the device.

Thus, according to the teachings of the invention, a simple manner of discharging any stored electric charge on cables may take place during insertion of the associated plug to the associated connector. In doing so, Ethernet switch reliability may be increased (or increased reliability of any device utilizing such a connector).

Figure 5:
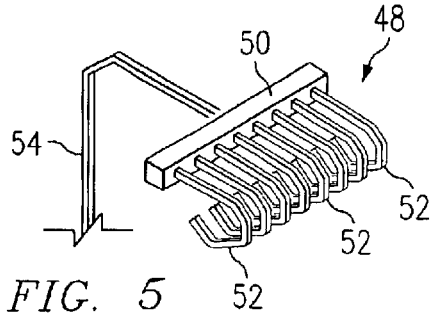
FIG. 5 is a perspective drawing of a discharge system showing an alternative to the discharge pins of FIG. 3A according to the teachings of the invention.

Details of example construction techniques for discharge pins 42 are described below in conjunction with FIG. 5. FIG. 5 illustrates an alternative to discharge pins 42. Rather than a plurality of discharge pins 42 coupled to ground termination circuit 44, a single discharge system 48 is utilized. In this approach, discharge system 48 includes a single conductor 50 with a plurality of teeth 52 coupled thereto. In this approach a single conductive lead 54 is transmitted to a ground termination circuit 44. Other approaches for discharge pins or systems may be utilized that result in electrical coupling of plug conductive pins during insertion, but with disconnection upon complete insertion. Alternatively, disconnection upon complete insertion may not be necessary if appropriate circuitry is utilized to ensure proper transmission of electrical signals along plug conductive pins 36.

In either of the embodiment of FIG. 5 or the embodiment of FIG. 3A, discharge pins 42 or discharge system 48 may be formed from metal, a conductive polymer, a resistive polymer, or other suitable materials. Generally, any sort of material that allows suitable electrical conductivity for the required application may be used. For example, use of a non-conductive plastic in most applications does not provide such conductivity. In particular embodiments it has been determined that a resistance for each discharge pin 42 that is less than one megaohm is desired and a resistance less than one kilohm is particularly desired.

Figure 6:
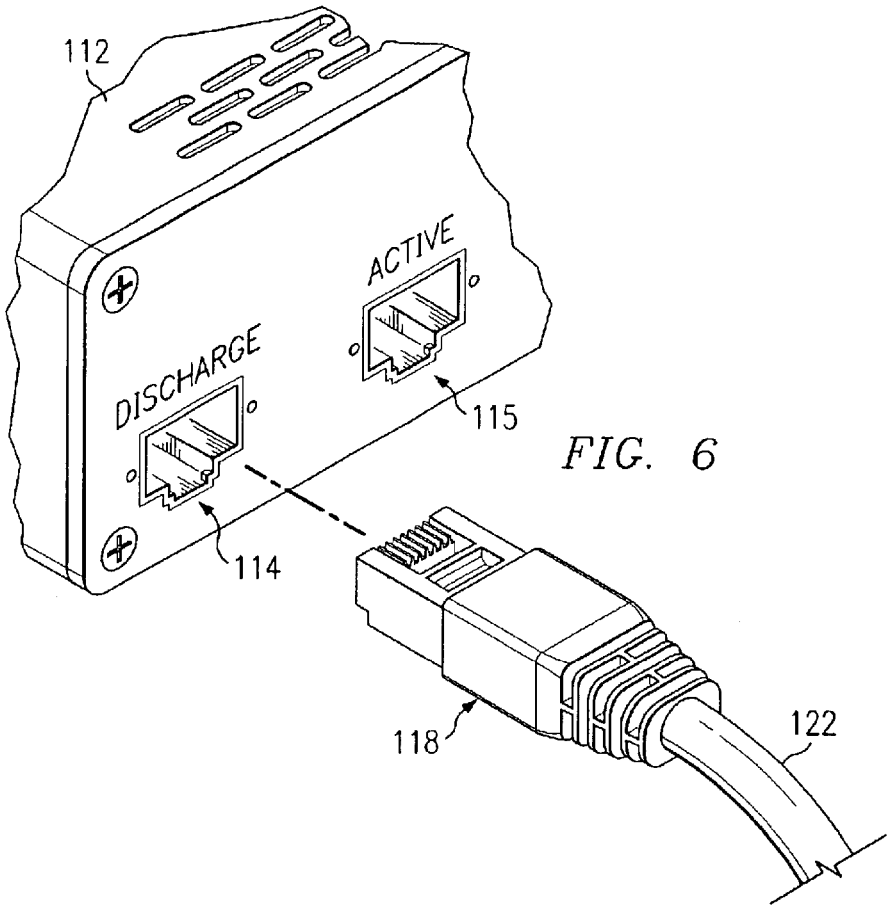
FIG. 6 is a perspective drawing of a system having both a discharge connector and an active connector according to the teachings of the invention.

FIG. 6 illustrates an alternative embodiment of a device 112 according to the teachings of the invention. In this embodiment device 112, which in this example is an Ethernet switch, includes both a discharge connector 114 and an active connector 115. Discharge connector 114 functions to discharge any charge stored on an associated plug 118. Active connector 115 functions in a conventional manner to provide operative electrical connections between device 112 and plug 118. Except for the differences described below, discharge connector 114 and plug 118 are analogous to connector 14 and connector 18, and may take various forms (RJ11, RJ45, etc.).

In operation, plug 118 is inserted into discharge connector 114, allowing discharge of any stored charge on plug 118. After such discharge has occurred, plug 118 is inserted into active connector 115 for operation. This approach allows another simple method for discharging any charge stored on plug 118. Additional details of discharge connector 114 are described below in connection with FIG. 7.

Figure 7:
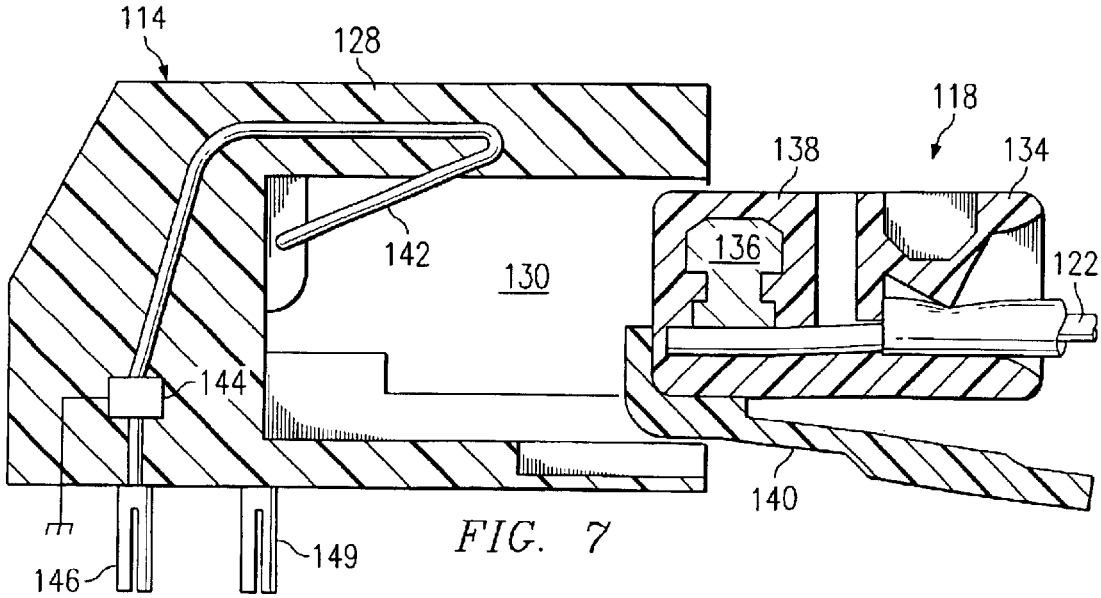
FIG. 7 is a cross-sectional diagram showing insertion of a plug into the discharge connector of FIG. 6 according to the teachings of the invention.

FIG. 7 is a cross-sectional diagram showing insertion of plug 118 into connector 114 according to an alternative embodiment of the teachings of the invention. As illustrated, plug 114 is similar to plug 14 except that connector 114 includes only one set of pins, namely, discharge pins 142; it does not include conductive pins 32 for operative connection. In the illustrated embodiment, discharge pins 142 have taken the configuration of connector pins 32 of FIG. 4A; however they could also take the form of discharge pins 42 of FIG. 4A, or other suitable configuration. Discharge pins 142 are coupled to discharge circuit 144, which is coupled to ground in an analogous fashion to discharge circuit 44.

In operation, plug 118 is inserted into cavity 130 of connector 114. Upon insertion to a great enough extent, connective pins 136 provide electrical contact to discharge pins 142, allowing discharge of any charge stored on plug 118 to discharge circuit 144, and thus to ground.

Although the present invention has been described in detail, it should be understood that various changes, substitutions, and alterations can be made hereto without departing from the spirit and scope of the invention as defined by the appended claims.

What is claimed is:

1. An apparatus comprising: a housing having:

an active RJ connector operable to mate with an RJ plug and establish an operative electrical connection between the RJ plug and the apparatus; and a discharge RJ connector physically separate from the active RJ connector and operable to receive the RJ plug and discharge any charge stored on the RJ plug, the discharge connector comprising a plurality of discharge pins each configured to contact a respective one of a plurality of conductive pins on the RJ plug when the RJ plug is inserted into the discharge RJ connector, the discharge RJ connector being inoperable to establish an operative electrical connection between the RJ plug and the apparatus.

2. The RJ connector of claim 1, wherein the plurality of conductive pins consists of four pins.

3. The RJ connector of claim 1, wherein the plurality of conductive pins consists of eight pins.

4. The RJ connector of claim 1, wherein the RJ plug is an RJ 45 plug and the RJ connector is an RJ 45 connector.

5. The RJ connector of claim 1, wherein the RJ plug is an RJ 11 plug and the RJ connector is an RJ 11 connector.

6. The RJ connector of claim 1, wherein each of the plurality of discharge pins has a resistance less than one megaohm.

7. The RJ connector of claim 1, wherein each of the plurality of discharge pins has a resistance less than one kilohm.

8. The RJ connector of claim 1, wherein each of the plurality of discharge pins is formed from metal.

9. The RJ connector of claim 1, wherein each of the plurality of discharge pins is formed from a conductive polymer.

10. The RJ connector of claim 1, wherein each of the plurality of discharge pins is formed from a resistive polymer.

11. The RJ connector of claim 1, wherein each of the plurality of discharge pins is formed from a material other than a non-conductive plastic.

12. The RJ connector of claim 1, and further comprising a discharge circuit electrically coupled to the plurality of discharge pins.

13. The RJ connector of claim 12, wherein the discharge circuit is operable to discharge the charge to ground.

14. The RJ connector of claim 13, wherein the discharge circuit comprises a short to ground.

15. The RJ connector of claim 13, wherein the discharge circuit comprises a resistor coupled to ground.

16. The RJ connector of claim 13, wherein the discharge circuit comprises a diode coupled to ground.

17. The RJ connector of claim 12, wherein the discharge circuit is formed within the connector.

18. The RJ connector of claim 12, wherein the discharge circuit is formed external to the connector.

19. The apparatus of claim 1, wherein the plurality of conductive pins comprising a number of conductive pins selected from the group consisting of four, six and eight.

20. The apparatus of claim 1, wherein the RJ connector is a type selected from the group consisting of RJ 45 and RJ 11.

21. A method for discharging charge stored on an RJ plug comprising:

providing an apparatus having a housing having:

an active RJ connector operable to mate with an RJ plug and establish an operative electrical connection between the RJ plug and the apparatus; and a discharge RJ connector physically separate from the active RJ connector and operable to receive the RJ plug and discharge any charge stored on the RJ plug, the discharge connector comprising a plurality of discharge pins each configured to contact a respective one of a plurality of conductive pins on the RJ plug when the RJ plug is inserted into the discharge RJ connector, the discharge RJ connector being inoperable to establish an operative electrical connection between the RJ plug and the apparatus;

inserting the RJ plug into the discharge RJ connector;

discharging the charge stored on the RJ plug onto the plurality of discharge pins;

removing the RJ plug from the discharge RJ connector; and inserting the RJ plug into the active RJ connector and establishing an operative electrical connection between the RJ plug and the apparatus.

22. The method of claim 21, wherein the plurality of conductive pins consists of four pins.

23. The method of claim 21, wherein the plurality of conductive pins consists of eight pins.

24. The method of claim 21, wherein the RJ plug is an RJ 45 plug and the RJ connector is an RJ 45 connector.

25. The method of claim 21, wherein the RJ plug is an RJ 11 plug and the RJ connector is an RJ 11 connector.

26. The method of claim 21, wherein each of the plurality of discharge pins has a resistance less than one megaohm.

27. The method of claim 21, wherein each of the plurality of discharge pins has a resistance less than one kilohm.

28. The method of claim 21, wherein each of the plurality of discharge pins is formed from metal.

29. The method of claim 21, wherein each of the plurality of discharge pins is formed from a conductive polymer.

30. The method of claim 21, wherein each of the plurality of discharge pins is formed from a resistive polymer.

31. The method of claim 21, wherein each of the plurality of discharge pins is formed from a material other than a non-conductive plastic.

32. The method of claim 21, and further comprising a discharge circuit electrically coupled to the plurality of discharge pins.

33. The method of claim 32, wherein the discharge circuit is operable to discharge the charge to ground.

34. The method of claim 33, wherein the discharge circuit comprises a short to ground.

35. The method of claim 33, wherein the discharge circuit comprises a resistor coupled to ground.

36. The method of claim 33, wherein the discharge circuit comprises a diode coupled to ground.

37. The method of claim 32, wherein the discharge circuit is formed within the connector.

38. The method of claim 32, wherein the discharge circuit is formed external to the connector.

* * * * *

UNITED STATES PATENT AND TRADEMARK OFFICE

CERTIFICATE OF CORRECTION

PATENT NO. : 6,790,097 B1
DATED : September 14, 2004
INVENTOR(S) : James W. Edwards et al.

It is certified that error appears in the above-identified patent and that said Letters Patent is hereby corrected as shown below:

Title page,
Item [56], References Cited, U.S. PATENT DOCUMENTS, delete "6,162,856 A1", and insert -- 6,612,856 B1 --.

Signed and Sealed this

Seventh Day of June, 2005

JON W. DUDAS
*Director of the United States Patent and Trademark Office*